US007086605B2

(12) United States Patent
D'Angelo, Jr. et al.

(10) Patent No.: US 7,086,605 B2
(45) Date of Patent: Aug. 8, 2006

(54) TOY VEHICLE SLOT TRACK

(75) Inventors: Vincent J. D'Angelo, Jr., Medford, NJ (US); James M. Dickinson, Haddon Township, NJ (US); Gerhart P. Huy, Hamilton Square, NJ (US); Dean C. Reisher, Brick, NJ (US)

(73) Assignee: Mattel, Inc., El Serundo, CA (US)

( * ) Notice: Subject to any disclaimer, the term of this patent is extended or adjusted under 35 U.S.C. 154(b) by 0 days.

(21) Appl. No.: 11/020,551

(22) Filed: Dec. 23, 2004

(65) Prior Publication Data

US 2005/0112994 A1 May 26, 2005

Related U.S. Application Data

(63) Continuation of application No. 10/326,645, filed on Dec. 19, 2002, now Pat. No. 6,883,720.

(60) Provisional application No. 60/423,186, filed on Nov. 1, 2002.

(51) Int. Cl.
*E01B 23/00* (2006.01)

(52) U.S. Cl. ..... 238/10 E; 446/446; 191/22 C

(58) Field of Classification Search ..... 238/10 E, 238/10 F, 10 B, 10 A, 10 C; 446/444, 445, 446/476, 446; 191/22 C; 273/86 B, 86 R
See application file for complete search history.

(56) References Cited

U.S. PATENT DOCUMENTS 3,205,833 A 9/1965 Fitzpatrick
3,377,958 A * 4/1968 Bax et al. ..... 463/63
3,402,503 A * 9/1968 Glass et al. ..... 463/63
3,466,043 A 9/1969 McRoskey et al.
3,712,615 A 1/1973 Staats et al.
4,140,276 A 2/1979 Halford
4,247,108 A 1/1981 Tilbor et al.
4,286,752 A 9/1981 Cheng
4,795,154 A 1/1989 Lahr
4,878,876 A 11/1989 Ishimoto
5,075,515 A * 12/1991 Yoneda et al. ..... 191/22 C (Continued)

FOREIGN PATENT DOCUMENTS

DE 3628729 A1 * 2/1986

OTHER PUBLICATIONS

TYCO Toys, Inc., "Tyco®" catalog, cover and page bearing designation TYCO®-*lok* "DUBBL" CHICANE adapter section, 1965-66, U.S.A.

(Continued)

*Primary Examiner*—Frantz F. Jules
(74) *Attorney, Agent, or Firm*—Akin Gump Strauss Hauer & Feld, L.L.P.

(57) ABSTRACT

A toy vehicle slot track is disclosed with at least a pair of toy racing vehicles and at least a pair of guide slots, each guide slot in turn having a pair of exposed power supply rails. The toy vehicles are guided about the track by guide pins affixed to the toy vehicles, the guide pins running within the guide slots. In a first portion of the track, the guide slots are spaced apart at a distance greater than the maximum width of the toy vehicles. In a second portion of the track, the guide slots are spaced apart at a distance less than the maximum width of the toy vehicles. The power supply rails run parallel to and at a uniform spacing from the guide slots in both portions of the track, providing power in both track portions to electric motors contained in the toy vehicles.

17 Claims, 4 Drawing Sheets

U.S. PATENT DOCUMENTS

| | | | |
|---|---|---|---|
| 5,141,469 | A | 8/1992 | Satake et al. |
| 5,218,909 | A | 6/1993 | Ng |
| 5,405,080 | A | 4/1995 | Yeung et al. |
| 5,970,882 | A | 10/1999 | Smith et al. |
| 6,109,186 | A | 8/2000 | Smith et al. |

OTHER PUBLICATIONS

Scalextric, catalog sheet and entitled "Side Swipes 350mm Each", one page, Apr. 16, 2004, email address code: http://www.scalextric.co.uk/pages/prod_det.aspx?id=1708.

Scalextric, catalog sheet and entitled "Radius 2 Racing Curve 90 DEG (2", one page, Apr. 16, 2004, email address code: http//www.scalextric.co.uk/pages/prod_det.aspx?id=1721.

Scalextric, catalog sheet and entitled "Changeover Track (2 pcs)", one page, Apr. 16, 2004, email address code: http//www.scalextric.co.uk/pages/prod_det.aspx?id=93.

Scalextric, catalog sheet and entitled "STD Curve Chicane", one page, Apr. 16, 2004, email address code: http//www.scalextric.co.uk/pages/prod_det.aspx?id=105.

Scalextric, catalog sheet and entitled "Straight Chicane", one page, Apr. 16, 2004, email address code: http//www.scalextric.co.uk/pages/prod_det.aspx?id=91.

Scalextric, catalog sheet and entitled "Short Chicane (2 pcs)", one page, Apr. 16, 2004, email address code: http//www.scalextric.co.uk/pages/prod_det.aspx?id=90.

Scalextric, catalog sheet and entitled "Skid Chicane" one page, Apr. 16, 2004, email address code: http//www.scalextric.co.uk/pages/prod_det.aspx?id=88.

* cited by examiner

TOY VEHICLE SLOT TRACK

CROSS-REFERENCE TO RELATED APPLICATIONS

This application claims benefit of U.S. Provisional Patent Application 60/423,186, "Toy Vehicle Slot Track", filed Nov. 1, 2002 and is a continuation of U.S. Non-provisional patent application Ser. No. 10/326,645 filed Dec. 19, 2002 now U.S. Pat. No. 6,883,720.

BACKGROUND OF THE INVENTION

The present invention relates to a toy vehicle slot track, and more particularly to a toy vehicle slot track having a first portion wherein guide slots disposed in an upper surface of the track are spaced apart at a first distance and a second portion wherein the guide slots are spaced apart at a second distance.

A variety of toy vehicle slot track constructions are known. Generally, the track construction comprises track segments having one or more guide slots for engaging a projecting pin on a toy vehicle which guide the toy vehicle around the track. The toy vehicles are typically powered through a pair of conductors embedded in the track.

Prior art track constructions have presented various configurations of the guide slots. For example, multiple guide slots which merge into a single slot or guide slots which intersect in criss-cross fashion are known in the prior art, providing enhanced play action of the track and toy vehicles. However, a scenario which is not replicated in the prior art is a "squeeze" maneuver seen in automobile racing, wherein the toy vehicles receive power during the maneuver. During a car race, drivers tend to move to the inner radius in a curved portion of a race track to maximize control of the race vehicle, and thus the cars tend to move through a curve more nearly in single file than the cars would move through a straight portion of the track. U.S. Pat. No. 5,075,515 discloses a toy vehicle slot track wherein the slots converge in a turn, simulating the squeeze maneuver. However, the invention of U.S. Pat. No. 5,075,515 does not provide power to the toy vehicles as the toy vehicles move through the turn with the converged slots.

BRIEF SUMMARY OF THE INVENTION

According to one aspect of the invention, a toy vehicle slot track for use with toy racing vehicles comprises at least one track section having an upper surface provided with a pair of guide slots disposed between two pairs of exposed power supply rails.

According to a second aspect of the invention, a toy vehicle slot track race set comprising a pair of toy race vehicles is disclosed. The toy race vehicles are essentially equal in width, and each toy race vehicle has a guide pin and a motor. At least one track section has an upper surface provided with a pair of non-intersecting guide slots. Each guide slot is provided with a pair of exposed power supply rails located so as to supply power to the motor of each toy race vehicle. The toy race vehicles are guided across the at least one track section by movement of the guide pin within the guide slot. The guide slots are spaced apart at a spacing which is less than a maximum width of each of the toy race vehicles.

According to yet a third aspect of the invention, a toy vehicle slot track for use with toy racing vehicles having a maximum width is disclosed. The track comprises an upper surface, with a plurality of separate guide slots disposed within the upper surface. The track further comprises a pair of power supply rails provided for each guide slot. The power supply rails are disposed within the upper surface on opposing sides of each guide slot. An adjoining pair of the plurality of guide slots in a first portion of the track are generally parallel and spaced apart at a first spacing which is greater than the maximum width of the toy racing vehicles. An adjoining pair of the plurality of guide slots in a second portion of the track are generally parallel and spaced apart at a second spacing which is less than the maximum width of the toy racing vehicles. A pair of the guide slots in a third portion of the track transition from the first spacing to the second spacing, while a pair of the guide slots in a fourth portion of the track transitioning from the second spacing to the first spacing. The pair of power supply rails run generally parallel to each guide slot at a generally uniform distance from each guide slot in each of the four portions of the track. A first length of the track may be formed by combining the first, third, second, fourth and first portions of the track in sequence.

According to still yet a fourth aspect of the invention, a toy vehicle slot track race set comprises a pair of toy race vehicles, each toy race vehicle having a maximum width, the maximum widths being generally equal for the pair of the toy race vehicles. Each toy race vehicle has an electric motor and a guide pin. The race set further comprises a track with an upper surface, a plurality of separate, non-intersecting guide slots disposed within the upper surface, and the guide slots being sized to receive and permit movement of the guide pins within the guide slots to guide the toy race vehicles about the track. A pair of exposed power supply rails are provided for each guide slot, disposed on opposing sides of each guide slot and providing power to the electric motor of each toy race vehicle in one of the slots. A first portion of the track is formed from at least one generally straight track segment having a pair of guide slots arranged generally parallel to one another and spaced apart at a first spacing which is greater than the maximum width of the toy racing vehicles. A second portion of the track is formed from at least one curved track segment having a pair of guide slots disposed toward an inner radius of the at least one curved track segment and arranged generally parallel to one another and spaced apart at a second spacing which is less than the maximum width of the toy racing vehicles. The pair of guide slots are disposed between two pairs of exposed power supply rails, and also a third guide slot is arranged to mate with one of the guide slots of the first portion of the track. A third portion of the track is formed from at least one generally straight track segment with a first end where a pair of guide slots are arranged to mate with the arrangement of the guide slots of the first portion of the track and with a second end where the pair of guide slots are arranged to mate with the arrangement of the pair of guide slots of the second portion of the track. A fourth portion of the track is formed from at least one generally straight track segment with a first end where a pair of guide slots are arranged to mate with the arrangement of the pair of guide slots of the second portion of the track and with a second end where the pair of guide slots are arranged to mate with the arrangement of the guide slots of the first portion of the track. The pair of power supply rails run generally parallel to each guide slot at a generally uniform distance from each guide slot in each of the four portions of the track.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
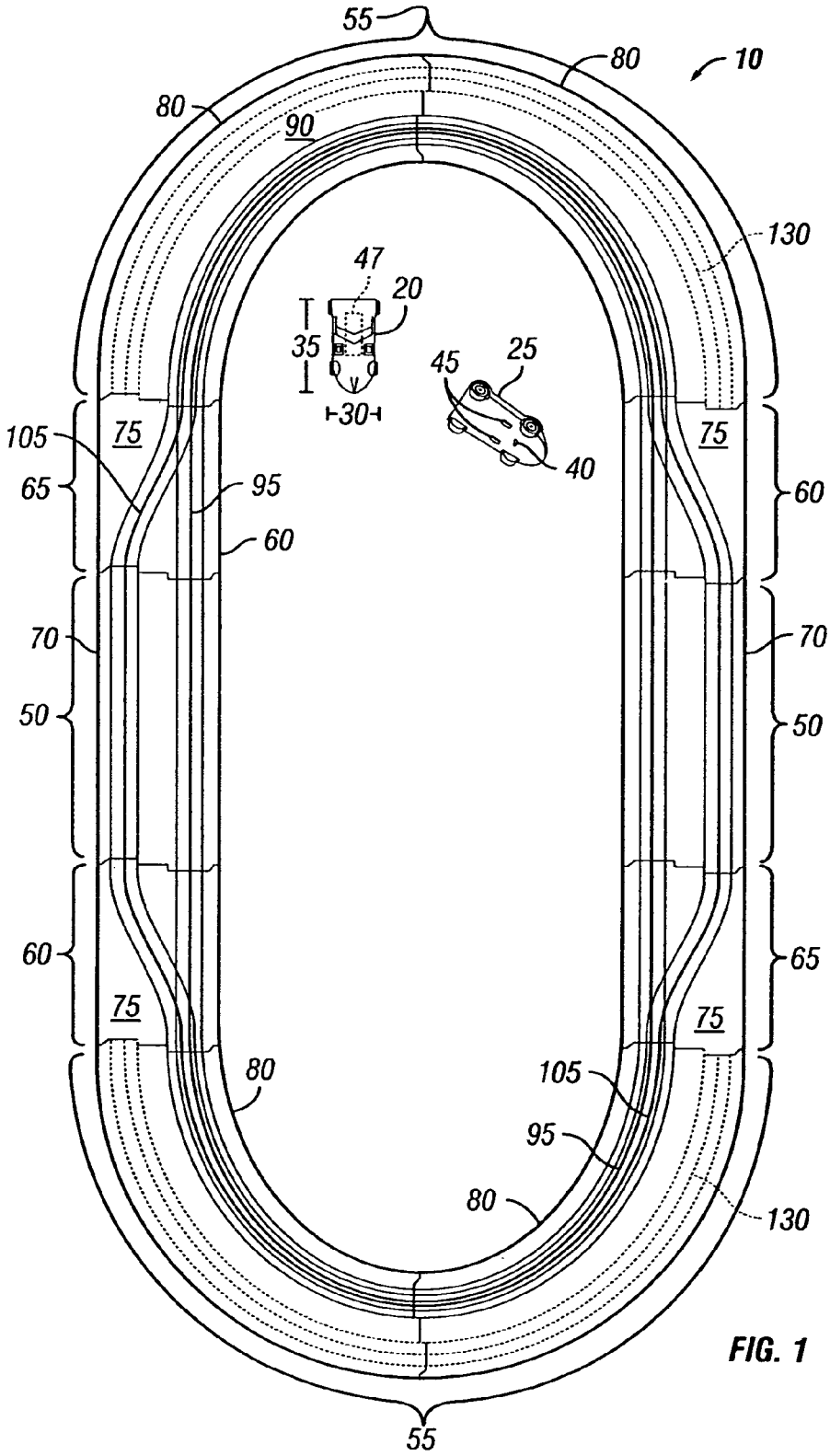
FIG. 1 is a top plan view of one embodiment of the present invention showing a toy vehicle slot track assembled in a generally oval configuration.

Certain terminology is used in the following description for convenience only and is not limiting. The words "right", "left", "top", and "bottom" designate directions in the drawings to which reference is made. The words "interior" and "exterior" refer to directions toward and away from, respectively, the geometric center of the toy vehicle slot track and designated parts thereof. The terminology includes the words above specifically mentioned, derivatives thereof and words of similar import.

Referring to the figures, wherein like numerals are used to indicate like elements throughout, there is shown in FIGS. 1–4, a preferred embodiment of a toy vehicle slot track, generally designated 10, in accordance with the present invention.

Referring now to FIG. 1, the toy vehicle slot track 10 is shown assembled in a generally oval-shaped configuration. Also illustrated are a first toy vehicle 20 and a second toy vehicle 25. Each toy vehicle 20 and 25 has a maximum width 30 and a length 35. FIG. 1 further illustrates that the toy vehicles 20 and 25 are provided with guide pins 40 and electrical contacts 45 on their bottom surfaces and a motor 47 (shown in phantom).

FIGS. 1–4 illustrate that the toy vehicle slot track 10 is comprised of four track portions: a first track portion 50, formed from generally straight passing track segments 70 wherein guide slots 95 and 105 (described later herein) are spaced at a first spacing 115 (also described later herein) to allow the toy vehicles 20 and 25 to pass one another; a second track portion 55, formed from one or more curved no passing track segments 80 wherein the guide slots are spaced at a second spacing 145 (described later herein) to prevent the toy vehicles 20 and 25 from passing one another; a third track portion 60, formed from a generally straight transition track segment 75 wherein the guide slots 95, 105 converge from the first spacing 115 to the second spacing 145; and a fourth track portion 65, formed also from the transition track segment 75, but reversed in orientation so the guide slots 95, 105 diverge from the second spacing 145 to the first spacing 115. The track 10 includes an upper surface 90. Those of ordinary skill in the art will appreciate from the figures and the description herein that each end of each track segment 70, 75 and 80 has connection elements arranged to allow a releasable mating engagement between track segments 70, 75 and 80. Although the track segments 70 and 75 are shown as being straight and track segments 80 shown as curved, it will be understood that the track segments 70, 75 and 80 may be a variety of shapes including but not limited to straight, curved or S-shaped, and can be assembled in a variety of configurations to form an endless race track loop. The track segments 70, 75 and 80 are preferably formed from ABS plastic using conventional techniques well-known to those of ordinary skill in the art. Other materials, for example PVC plastic, composite materials, wood or metal and other fabrication techniques, for example machining or stamping, could be used to fabricate the track segments 70, 75 and 80.

Figure 2:
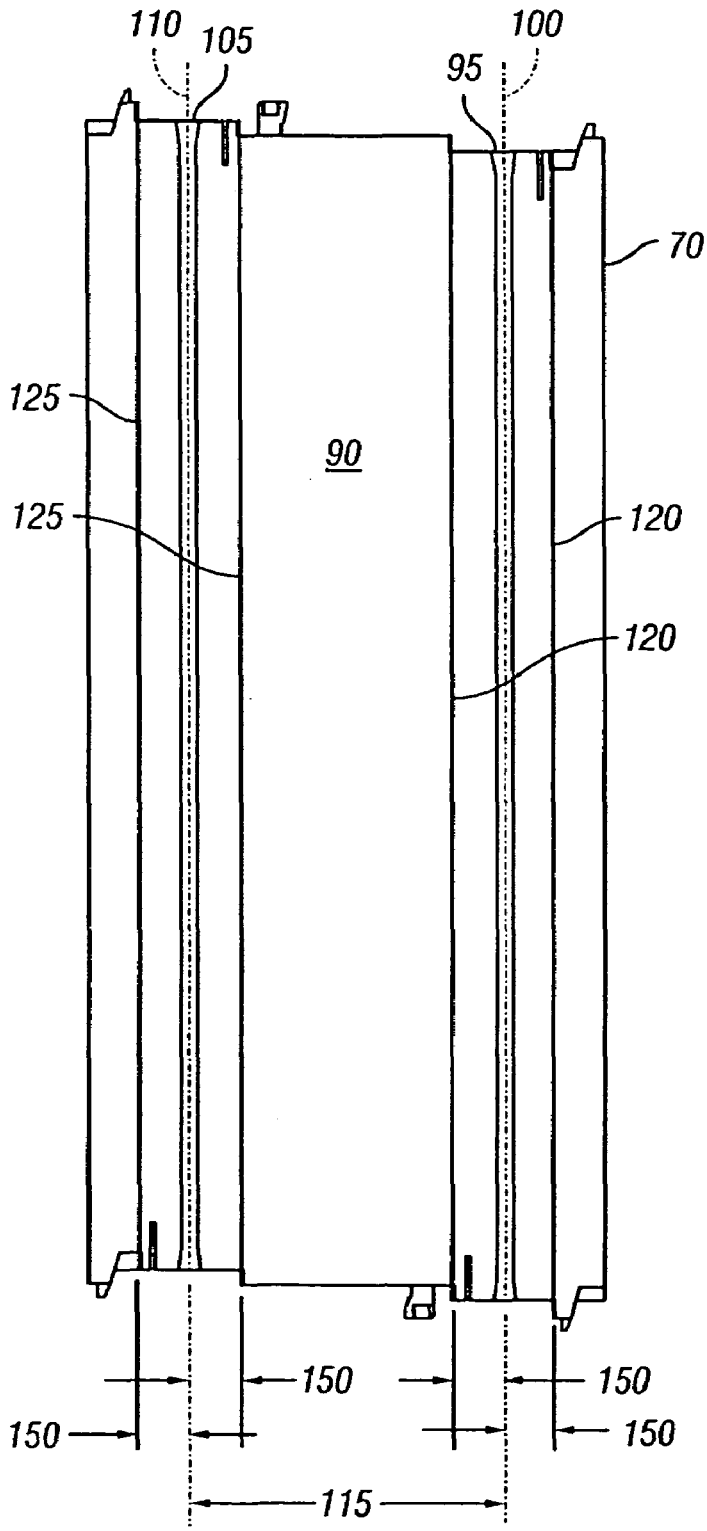
FIG. 2 is a top plan view of a first type of track segment comprising the toy track of FIG. 1.

With particular reference to FIG. 2, the passing track segment 70 which forms the first track portion 50 is illustrated. In the embodiment shown, two guide slots 95 and 105 are provided in the upper surface 90 of the track segment 70. Each guide slot 95 and 105 has a centerline 100 and 110, respectively. Each guide slot 95 and 105 is further provided with a pair of power supply rails 120 and 125, respectively. The power supply rails 120 and 125 are disposed within the upper surface 90, and exposed. The power supply rails 120 and 125 run generally parallel to the guide slots 95 and 105, respectively, at a predetermined spacing 150 from the centerlines 100 and 110, respectively. The centerlines 95 and 105 are spaced at a first perpendicular spacing 115. This first perpendicular spacing 115 is greater than the maximum width 30 of the toy vehicles 20, 25, and consequently toy vehicles 20 and 25, one running in guide slot 95 and the other in guide slot 105, are able to pass one another when operating over the track segment 70.

Figure 3:
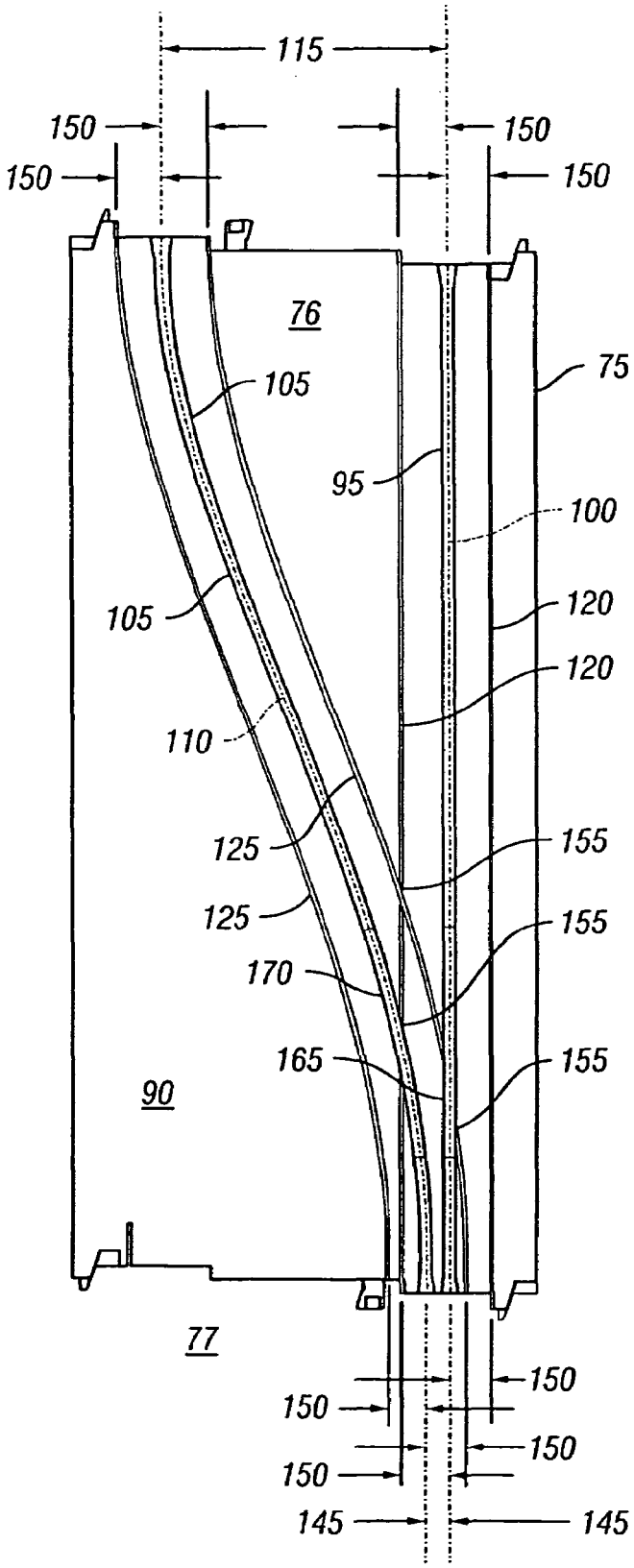
FIG. 3 is a top plan view of a second type of track segment comprising the toy track of FIG. 1.

Now with particular reference to FIG. 3, the transition track segment 75 which forms the third and fourth track portions 60 and 65 is illustrated. In the embodiment shown, the two guide slots 95 and 105 are provided in the upper surface 90 of the track segment 75. Characteristics of the guide slots 95 and 105, guide slot centerlines 100 and 110 and power supply rails 120 and 125 are similar to the characteristics identified above with reference to track segment 70 with the exception that the guide slots 95 and 105 transition from the first perpendicular spacing 115 at a first end 76 of the track segment 75 to a second perpendicular spacing 145 at a second end 77 of the track segment 75. FIG. 2 illustrates that in making the transition from the first spacing 115 to the second spacing 145, it is necessary to provide electrical bridges 155 below the exposed track upper surface 90 at a point 160 where one of each of the pairs of rails 120 and 125 intersect and at first and second points 165 and 170 where one of the rails 125 intersects with the guide slot 95 and one of the rails 120 intersects with guide slot 105.

Figure 4:
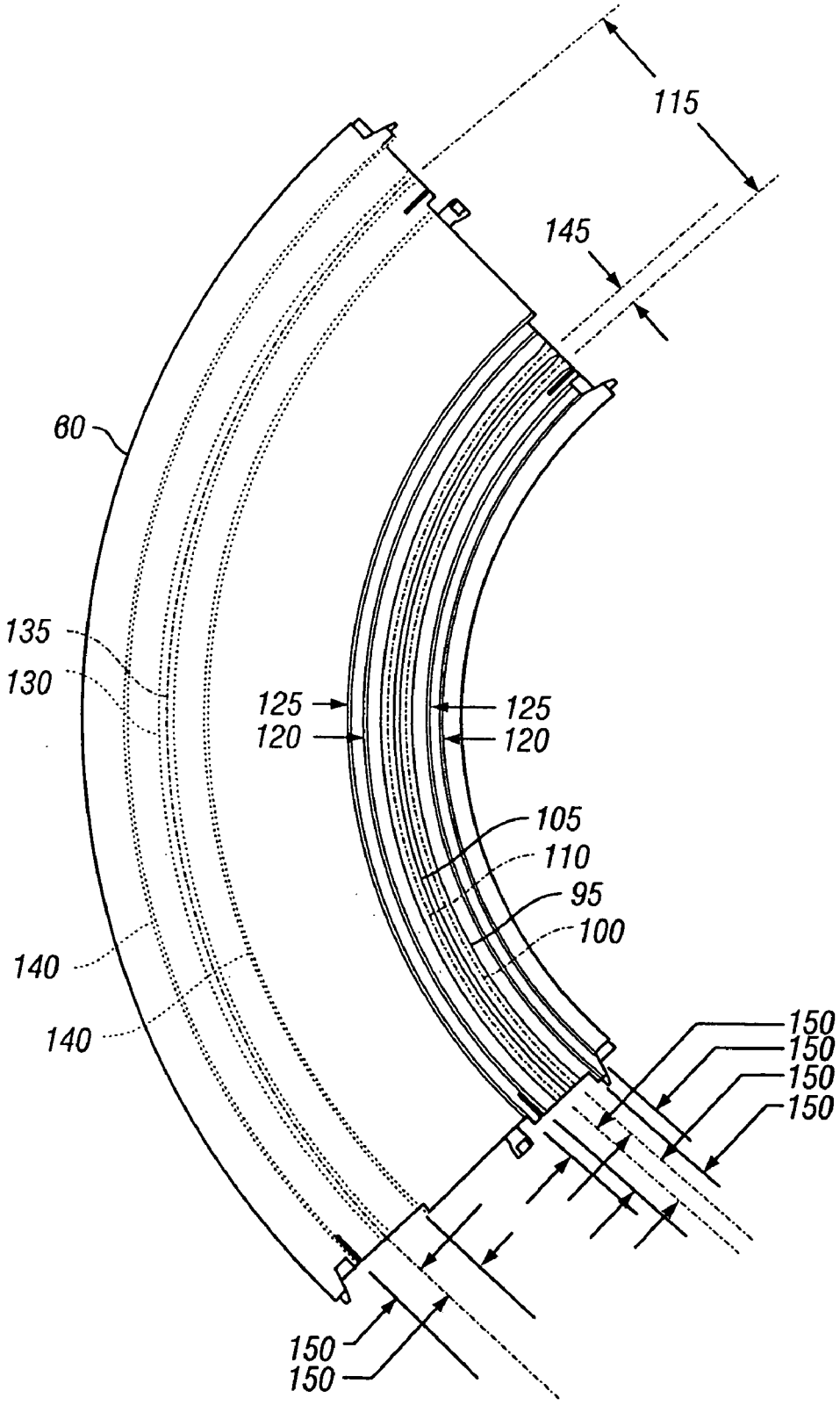
FIG. 4 is a top plan view of a third type of track segment comprising the toy track of FIG. 1.

Now with particular reference to FIG. 4, the no-passing track segment 80 which forms the second track portion 55 is illustrated. In the embodiment shown, the two guide slots 95 and 105 are provided in the upper surface 90 of the track segment 80. Characteristics of the guide slots 95 and 105, guide slot centerlines 100 and 110 and power supply rails 120 and 125 are similar to the characteristics identified above with reference to the track segment 70 and track segment 75, with the exception that the guide slots 95 and 105 are spaced at the second perpendicular spacing 145 over the entire length of the track segment 80. Thus, the guide slots 95, 105 are disposed side-by-side, with one power supply rail from each of the two pairs of power supply rails 120 and 125 disposed on each side of the guide slots 95, 105. A third guide slot 130 can be provided in the upper surface 90 of the track segment 80 as shown to mate directly with track sections 70, if desired. If provided, the third guide slot 130 has a centerline 135 and is provided with a pair of power supply rails 140. The centerline 100 and the centerline 135 are spaced apart at the first perpendicular spacing 115.

In operation, the track segments 70, 75 and 80 may be assembled, for example, in a arrangement similar to that illustrated in FIG. 1, of at least one track segment 70 followed by a track segment 75 followed by at least one track segment 80 followed by another track segment 75 followed by at least one track segment 70. Thus combined, a length of track 10 wherein the toy vehicles 20 and 25 would be prevented from passing in the second portion 55 of the track 10 would thus be formed. Alternatively, a length of track 10 could be formed by combining at least one track segment 70 followed by at least one track segment 80, provided with the optional third guide slot 130, followed by at least one track segment 70. A length of track 10 wherein the toy vehicles 20 and 25 would not be prevented from passing in the second portion 55 of the track 10 would thus be alternatively formed.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

The invention claimed is:

1. A toy vehicle slot track formed from a plurality of track sections comprising at least one track section having an upper surface provided with first and second non-intersecting guide slots, and with a first and a second power supply rail spaced substantially equally from the first guide slot and located on first and second sides of the first guide slot, respectively, and with a third and a fourth power supply rail spaced substantially equally from the second guide slot and located on first and second sides of the second guide slot, respectively, wherein paths of the first and fourth power supply rails do not intersect with the path of any other power supply rail, and paths of the second and third power supply rails intersect with one another.

2. The toy vehicle slot track of claim 1, wherein the at least one track section is substantially straight.

3. The toy vehicle slot track of claim 1, wherein the at least one track section has a first end and a second end, wherein at the first end, the second and third power supply rails are adjacent one another and separated from the first and fourth power rails by the first and second guide slots, respectively, and wherein at the second end, the third power supply rail is positioned on the first side of the first guide slot, adjacent the first power supply rail, the second power supply rail is positioned on the second side of the second guide slot, adjacent the fourth power supply rail, and the second and third power rails are separated from one another by the first and second guide slots.

4. The toy vehicle slot track of claim 3, wherein at the first end, centerlines of the first and second guide slots are separated by a first spacing perpendicular to the centerlines and, at the second end, the centerlines of the first and second guide slots are separated by a second spacing perpendicular to the centerlines and smaller than the first spacing.

5. The toy vehicle slot track of claim 4, in combination with a toy racing vehicle having a maximum width greater than the second spacing.

6. The toy vehicle slot track of claim 4, in combinatian with a toy racing vehicle having a maximum width less than the first spacing.

7. The toy vehicle slot track of claim 4, further comprising at least a first and a second additional track section each having an upper surface provided with first and second non-intersecting guide slots, wherein centerlines of the first additional track section first and second guide slots are separated by a perpendicular distance equal to the first spacing, and the centerlines of the second additional track section first and second guide slots are separated by a perpendicular distance equal to the second spacing.

8. The toy vehicle slot track of claim 7, the second additional track section further including a third guide slot and fifth and sixth power supply rails on opposite sides of the third guide slot, wherein a centerline of the second additional track section third guide slot is spaced from a centerline of the second additional track section second guide slot at a perpendicular distance equal to the first spacing.

9. The toy vehicle slot track of claim 8, wherein a first length of the track may be formed by combining the first additional track section and the second additional track section in sequence.

10. The toy vehicle slot track of claim 7, wherein the first additional track section is substantially straight.

11. The toy vehicle slot track of claim 7, wherein the second additional track section is curved.

12. The toy vehicle slot track of claim 7, wherein a first length of the track may be formed by combining the first additional track section, the at least one track section, and the second additional track section in sequence.

13. The toy vehicle slot track of claim 1, wherein the at least one track section is substantially curved.

14. The toy vehicle slot track of claim 13, wherein the at least one track section has a third guide slot extending along the track section at a uniform spacing from the first guide slot and a fifth and sixth power supply rail spaced substantially equally from the third guide slot and located on either side of the third guide slot, wherein a path of each of the third guide slot and the fifth and sixth power rails fails to cross the paths of any of the first and second guide slots and the first through fourth power rails.

15. The toy vehicle of claim 14 wherein the spacing between the first guide slot and each of the first and the second power rails, between the second guide slot and each of the third and the fourth power rails, and between the third guide slot and each of the fifth and sixth guide rails is equal all along the at least one track section.

16. A toy vehicle slot track for use with toy racing vehicles, the track comprising at least one track section having an upper surface provided with a pair of non-intersecting guide slots disposed between two pairs of exposed power supply rails, wherein each guide slot of the pair of guide slots is centered between only two of the power supply rails of the two pairs of power supply rails by being equally spaced from each of the only two power supply rails.

17. A toy vehicle slot track for use with toy racing vehicles, the track comprising at least one track section having an upper surface provided with a pair of non-intersecting guide slots disposed between two pairs of exposed power supply rails, wherein a first guide slot of the pair of guide slots is centered between a first set of two power supply rails of the two pairs of power supply rails by being equally spaced from each rail of the first set of power supply rails and wherein a second guide slot of the pair of guide slots is centered between a second set of power supply rails mutually exclusive with the first set of power supply rails by being equally spaced from each rail of the second set of power supply rails.

* * * * *